US007458243B2

(12) United States Patent
Ruzovic et al.

(10) Patent No.: US 7,458,243 B2
(45) Date of Patent: Dec. 2, 2008

(54) SPRING WINDING MACHINE AND A METHOD FOR CONTROLLING A SPRING WINDING MACHINE

(75) Inventors: Martin Ruzovic, Fislisbach (CH); Josef Reissner, Brugg (CH)

(73) Assignee: Spuhl AG, Wittenbach (CH)

( * ) Notice: Subject to any disclaimer, the term of this patent is extended or adjusted under 35 U.S.C. 154(b) by 93 days.

(21) Appl. No.: 10/556,372

(22) PCT Filed: May 10, 2004

(86) PCT No.: PCT/CH2004/000284

§ 371 (c)(1),
(2), (4) Date: Nov. 10, 2005

(87) PCT Pub. No.: WO2004/101193

PCT Pub. Date: Nov. 25, 2004

(65) Prior Publication Data

US 2006/0230803 A1 Oct. 19, 2006

(30) Foreign Application Priority Data

May 13, 2003 (CH) ..... 0827/03

(51) Int. Cl.
*B21F 3/02* (2006.01)
*B21C 37/00* (2006.01)

(52) U.S. Cl. ..... 72/135; 72/17.3

(58) Field of Classification Search ..... 72/16.1, 72/16.2, 16.3, 16.4, 17.3, 18.1, 18.2, 135, 72/138, 441, 19.6, 19.7; 73/160
See application file for complete search history.

(56) References Cited

U.S. PATENT DOCUMENTS

| | | | | | |
|---|---|---|---|---|---|
| 4,538,463 | A * | 9/1985 | Pease | 72/17.3 |
| 4,991,277 | A * | 2/1991 | Itaya | 140/71.5 |
| 5,243,746 | A * | 9/1993 | Shinichi | 140/71.5 |
| 5,477,715 | A * | 12/1995 | Kempf | 72/135 |
| 5,761,943 | A * | 6/1998 | Blasius | 72/135 |
| 5,839,312 | A * | 11/1998 | Itaya | 72/135 |
| 5,865,051 | A * | 2/1999 | Otzen et al. | 72/17.3 |
| 5,875,664 | A * | 3/1999 | Scott et al. | 72/16.1 |
| 6,572,591 | B2 * | 6/2003 | Mayer | 604/249 |

* cited by examiner

*Primary Examiner*—Derris H Banks
*Assistant Examiner*—Teresa Bonk
(74) *Attorney, Agent, or Firm*—Wood, Herron & Evans, LLP

(57) ABSTRACT

The spring winding machine (1) comprises a measuring device (25*a*) with a measuring sensor (27) which is arranged in front of the shaper (11) with respect to the conveyor direction of the wire (13) to be shaped. The activation of the shaper (11) is changed by the measured variables of the measuring sensor (27) with respect to a predefined activation function ($K_1$) in a manner such that the shaped wire has the desired spring properties.

8 Claims, 2 Drawing Sheets

SPRING WINDING MACHINE AND A METHOD FOR CONTROLLING A SPRING WINDING MACHINE

Figure 1:
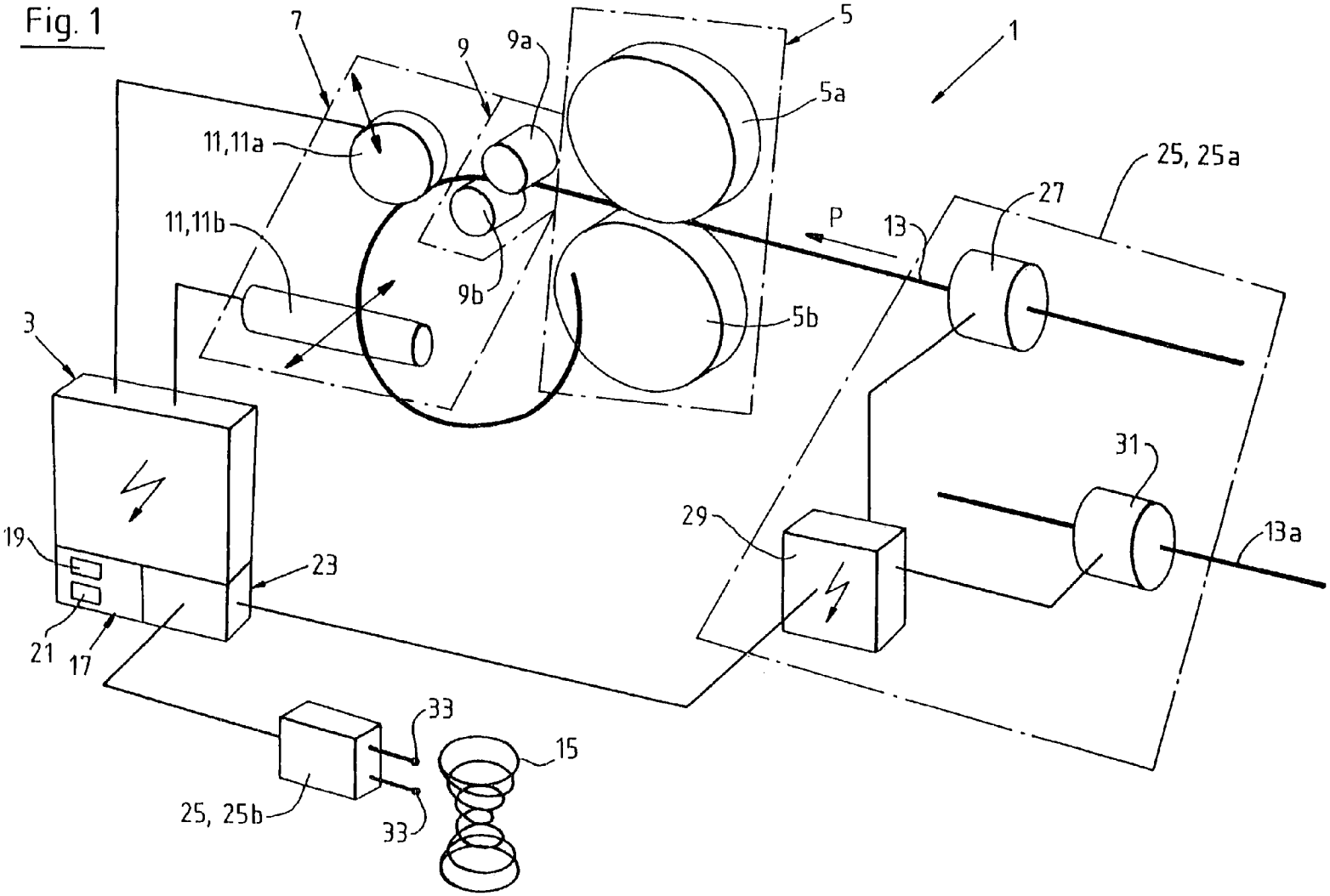

The subject matter of the invention is a spring winding machine and a method for controlling a spring winding machine, according to the preamble of patent claims 1 and 7.

With spring winding machines as are for example employed for manufacturing wound spring such as mattress springs and cushioned furniture springs, technical tension and compression springs as well as leg springs, inasmuch as they comprise at least one wound body, as a rule a spring wire is removed from a swift by way of a conveying device and led to a shaping device. The shaping device may comprise one or more winding tools which on advance deflect the spring wire and by way of this shape this into a spring. According to the manner of functioning of the spring winding machine, the winding tools may be fixedly and immovably connected to the machine, or movably held on the machine during the spring manufacturing process. In the latter case the movement of the tools may for example be effected by a rotatable cam disk or by a servomotor and/or a piezotranslator.

On account of the inhomogeneities or non-constant chemical and/or physical properties of the wire, the properties of the manufactured springs may differ from the desired nominal properties to a greater or lesser extent. Thus for example material properties such as wire diameter, warpings or twistings, composition of the interweaving, inner stresses or micro-fracture fields may have an effect on the tensile strength, the modulus of elasticity or other properties influencing the deformability of the wire. On account of the inhomogeneities of the wire also its electrical properties such as the conductivity or the impedance or the permeability within the wire may be different at different positions. The material inhomogeneities may lead to the fact that the properties of the manufactured springs are not constant. In particular shape parameters such as e.g. the winding diameter, pitch etc. and/or mechanical properties such as e.g. the spring constants may have considerable ranges. The manufacture of geometrically exact springs with properties within tight tolerance limits often becomes difficult.

From DE-A1-19534189 there is known an adaptive spring winding device with which there are provided means for improving the consistency of the spring properties. Downstream after the shaping tool there are provided means for monitoring the wire and for producing output signals which are characteristic of the physical characteristics of the bent wire. The output signals are led to the control and are used by this for the fine positioning of the shaping tool or its position, and specifically in a manner such that the outer diameter or inner diameter of the springs are retained.

A disadvantage of this spring winding device lies in the fact that the influence of different wire properties on the physical properties of the spring to be manufactured may only be detected with or after the shaping process. Only after the measurement of the inner diameters or outer diameters which differ from nominal values may the control cause a position correction of the winding tools. One must again and again reckon with springs being produced whose spring properties differ from the desired spring properties. In the case that tight tolerances are to be kept to, such springs need to be sorted out.

It is therefore the object of the invention to create a spring winding machine and a method for manufacturing springs, with which desired measured variables differ as little as possible from predefined nominal variables.

This object is achieved by a spring winding machine with a measuring device and by a method for manufacturing springs according to the features of the patent claims 1 and 7.

The spring winding machine according to the invention comprises a measuring device with at least one measuring sensor arranged in front of the shaper in the conveying direction of the wire. The measuring sensor or sensors detect measured quantities of the wire to be shaped, said measured quantities being defined or co-determined by the physical and/or chemical properties of the wire. According to the invention the machine control not only controls the shaping device in dependence of predefined instructions or commands but also in dependence of measured quantities which are detected by the sensors which are arranged in front of the wire shaping installation. The processing instructions on how the measured readings are to be processed into control variables for the shaping device may be predefined or predefinable in a fixed manner but may also be evaluated by the control itself. In a preferred embodiment of the invention the control may detect further input or measured variables which are linked to the properties of the manufactured springs. The control in particular may detect manual inputs at a user interface, thus for example correction inputs for the position and orientation control of a shaper which lead to the fact that the springs have the desired nominal properties. This corresponds to an open control loop with which a model is formed or adapted with processing settings. The control alternatively or additionally may also detect measured variables of test sensors which represent properties of the manufactured springs or deviations of the properties from desired nominal properties which are able to be stored in the memory medium of the control.

According to the invention the control is designed such that the measured variables of the prior arranged measuring sensors and, input and measured variables which are related to the properties of the manufactured springs, are set in a relationship to one another and one may form correlations between the measured variables and/or the functions derived from the measured variables. In this manner the control may determine regularities between the measured variables of the prior-arranged measuring sensors and the properties of the manufactured springs. In particular the control, taking account of the measured variables of the measuring sensors, may activate or influence the shaping device in a manner such that the manufactured springs have the desired and predefined nominal properties and thus compensate fluctuations of the wire properties.

Figure 2:
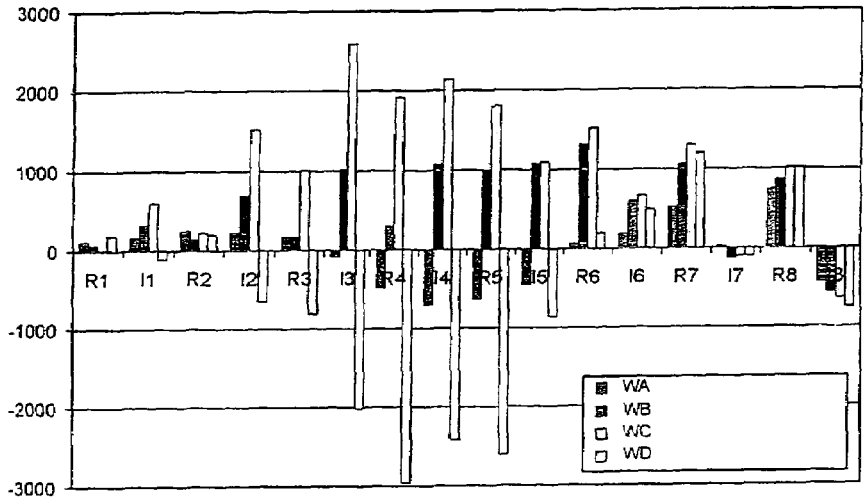
Figure 3:
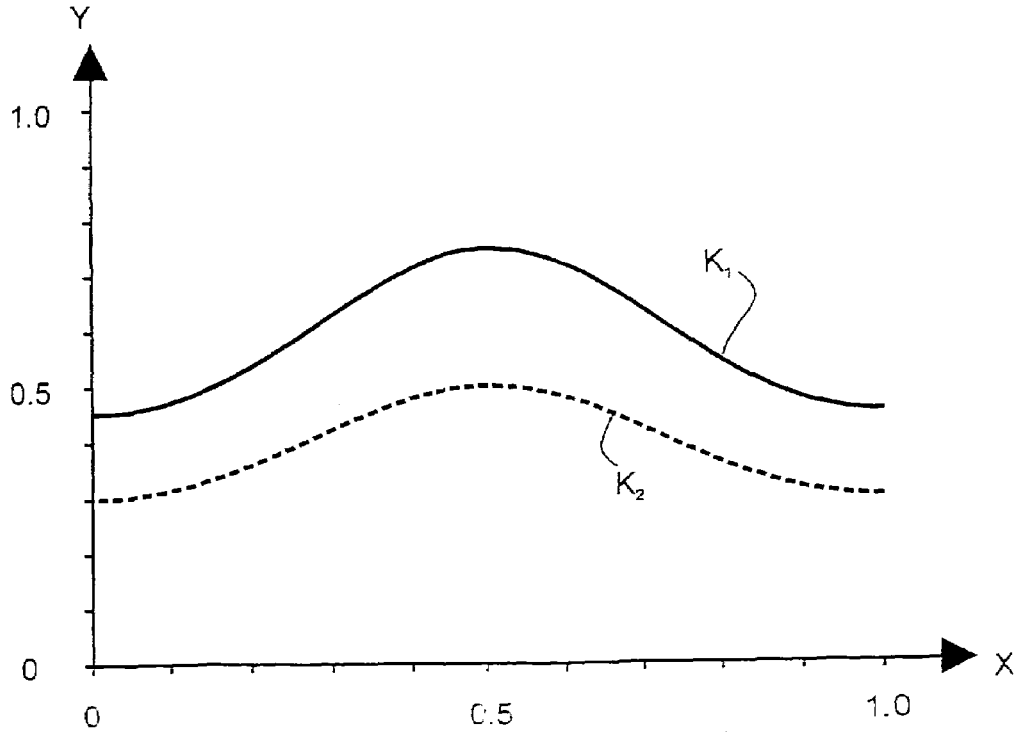

A preferred embodiment of the spring winding machine according to the invention and the method according to the invention for manufacturing springs is described in more detail by way of a few examples. With this there are shown in:

FIG. 1 a schematic principle sketch of parts of a spring winding machine,

FIG. 2 a representation of readings of an eddy current measuring apparatus,

FIG. 3 an activation function for a shaper

FIG. 1 schematically shows a principle sketch with parts of a spring winding machine 1 which are significant to the invention. The spring winding machine 1 comprises an electronic machine control, in short control 3, a wire conveying means 5 with two wire pull-in rollers 5*a*, 5*b*, a wire shaping installation 7 with a supply part 9 comprising two support rollers 9*a*, 9*b* or a (non-shown) supply baton as well as at least one shaper 11. The control 3 may comprise one or more components. In particular the control 3 may comprise a conventional machine control and a PC or industrial computer connected to this control. In the embodiment of the invention shown in FIG. 1, as a shaper 11 there are provided a bender 11*a* for deflecting a spring wire, in short wire 13, in the radial direction or for forming the windings of a helical or mattress spring, and a deflector 11*b* for deflecting the wire 13 in the axial direction or for forming the pitch of the spring 15. The conveyor device of the wire 13 is indicated by an arrow P. The position and/or orientation of the bender 11*a* and of the deflector 11*b* may be set and controlled via actuators, for example via control motors, stepper motors or servomotors with or without gearing or via linear motors which for example may comprise piezoelectric translators or electromotorically or pneumatically drivable spindles. The means 11, 11*a*, 11*b* for deforming the wire 13 into a spring 13 may be adjusted, controlled and regulated by the control 3 before and/or after and/or during the manufacture of a spring according to the design of the spring winding machine. Preferably the processing cycle or the activation intervals for updating the position or orientation of the shaper are short and preferably lie in the region of a few milliseconds to about 100 ms. The control 3 comprises means for detecting input or measured variables, thus for example a user interface 17 with a monitor display 19 and a keyboard 21 and/or an apparatus interface 23 for connecting measuring devices 25 and/or programming or data reading devices as they are for example required for inputting nominal values or setting functions for the activation of the shaper 11. A first measuring device 25*a* for detecting wire properties which is connected to the control 3 comprises a measuring sensor which is arranged upstream of the wire shaping installation 7 such that it may detect the wire properties 3 before shaping the wire 13 into a spring 15. Basically the measuring sensor 27 may be designed for detecting the most varied of material parameters or properties of the wire 13 with any measuring method. Several measuring sensors 27 for detecting such measured variables may be applied. Thus for example an optical CCD sensor may detect dimensions and/or surface structures of the wire 13 and a temperature sensor its temperature and a coil may detect eddy currents or impedances. Preferably the first measuring sensor 25*a* comprises an eddy current measuring apparatus as for example is offered by the company IBG Prüfcomputer GmbH in Germany under the trademark description eddyliner® and the type description P or Px. Apparatus of this type as a rule are used for material examination and quality securement. In the application according to the invention the apparatus comprises an evaluation unit 29 and as a measuring sensor 27 a coil connected thereto. Additionally with certain types of eddy current measuring apparatus as a reference sensor 31 a further coil with a piece of reference wire 13*a* may be connected to the evaluation unit 29. With this arrangement any occurring offset of the measuring device 25*a* may be reduced or avoided, by which means the measuring range and the resolution for the wire 13 to be measured out may be optimised. The evaluation unit 29 controls the measuring sensor 27 after one another with a sequence of several different frequencies in the range of about 5 Hz to about 300 kHz. Preferably the activation is effected with a sinusoidal signal. Alternatively the activation signal may also be a superimposition of various sinusoidal signals. The activation may be effected continuously or in the form of a package of pulses. The evaluation unit 29 e.g. from the damping behaviour of the signals and/or from other measured variables which may be influenced by these signals determines the real component $R_i$ and imaginary components $I_1$ of the impedance Z at several or all measuring frequencies, wherein the index i may assume integer values between one and for example 8. In place of or additionally to the impedance Z one could also detect other measured variables which may be influenced by the damping behaviour of the excitation signals or by induction or eddy currents which are generated by the excitation signals.

The readings are transferred to the control 3 or they may be called up by the control 3.

FIG. 2 by way of example, for 4 different wires 13 which are indicated with WA, WB, WC, WD shows the readings evaluated or detected by the measuring device 25*a* at the measuring frequencies $f_1$=25 Hz, $f_2$=80 Hz, $f_3$=250 Hz, $f_4$=630 Hz, $f_5$=1.6 kHz, $f_7$=10 kHz, $f_8$=25 kHz, wherein in each case for each of the frequencies $f_i$ firstly the real component $R_i$ and subsequently the imaginary component $I_i$ are indicated in a constant succession. The scale on the ordinate indicates scaled readings with respect to a reference value of the impedance. One may clearly recognise that the real and imaginary components of the evaluated impedance values for certain measuring frequencies $f_i$ and for the wires 13 indicated with WA, WB, WC and WD assume characteristic values. These values correspond to a fingerprint of the respective wire 13 which may be determined by different properties such as e.g. chemical composition, structural constitution, internal mechanical stresses, surface treatment, electrical conductivity, permeability, temperature, outer diameter, shape of the cross sectional surface etc.

With the shaping of the wire 13 into a spring 15 with an unchanged setting of the shaper 11 such wire properties may lead to the fact that the actual properties deviate from the desired nominal properties of the springs 15. Thus for example the inner or outer diameter of a helical spring may be too small or too large and/or the pitch of the spring 15 may deviate from the desired spring pitch. It is just as well possible that the spring 15 although corresponding to the set values with regard to size and shaping, has a spring constant differing from a nominal value.

Such deviations may be determined manually by a person, for example by visual control and/or by measurement. A person subsequently via the user interface 17 may instruct the control 3 to adapt the shaper 11 in a manner such that the subsequently manufactured springs 15 again have the desired properties. The setting or correction may then be based on empirically evaluated data.

FIG. 3 shows a possible activation function for the shaper 11*a* on manufacture of a mattress spring. The horizontal direction X corresponds to the advance length of the wire 13 during manufacture of the spring. In the vertical direction Y there is indicated the deflection or position or orientation of the bender 11*a*. The scaling of the two co-ordinate directions is in each case standardised with respect to the maximal possible co-ordinate values so that the possible value region of each coordinate extends from zero to one. The control curve marked with $K_1$ corresponds to the ideal activation function for the bender 11*a* for a real reference wire. The control 3 may store such a control curve in a (non-shown) memory for each spring type to be manufactured. The control curve may for example be stored by parameters of a polynomial function or by Fourier coefficients or alternatively as a Look-up table, wherein the corresponding deflection values are stored for e.g. one hundred support locations distributed uniformly over the whole wire length.

If the properties of the springs 15 manufactured with the activation function $K_1$ deviate from the desired properties, thus for example the outer diameter of the springs 15 is too large or too small on account of changed wire properties, or the spring pitch lies outside a tolerance region of for example 2% or 5% of a predefined nominal value, the control 3 by way of an adapted activation function $K_2$ (shown in FIG. 3 by a broken line) may again manufacture springs 15 with the desired properties. Such an adaptation of the control function may for example be effected by multiplication of the activation values stored in the table by a correction factor and/or by addition or subtraction of a correction value. In place of such corrections which are valid for the entirety of all support locations there may also be effected different corrections for the values at individual support locations or for groups of support locations. Of course the activation values may also be adapted in a manner such that non-geometric spring properties such as for example the spring constant or with progressive springs a suitable function given different wire properties are retained, wherein then the shape of the springs 15, e.g. their spring pitch may vary.

Alternatively or additionally the detection of deviations of spring properties may also be effected automatically with a second measuring device 25*b* with suitable test sensors 33. Thus for example the outer diameter of an end ring and/or the inner diameter of the narrowest winding and/or the spring pitch may be detected with a camera-based picture processing system (no representation). Analogously to the manual adaptation of the activation function $K_1$ the control 3, the activation function $K_1$ or the activation values may be adapted to the individual support locations automatically by way of the measured variables of the second measuring device 25*b* or corrected as soon as these measured variables lie outside a tolerance region set by the control 3. The adaptation of the control function $K_1$ may be effected by way of processing instructions which are predefined in the control 3. The control 3 furthermore comprises a monitoring means (not shown) or an algorithm for ascertaining the correlation between a) the activation functions and/or corrections of these activation functions and/or of the spring properties detected by the test sensors 33 and/or of deviations of these spring properties from nominal properties and b) the wire properties detected by the measuring sensors.

The algorithm may take into account the delay between the detection of the wire properties by the measuring sensors 27 spatially arranged in front of the shaper and the effect on the subsequently manufactured springs 15.

One possibility for evaluating such correlations is explained hereinafter by way of example:

After the first setting into operation of the spring winding machine 1 the control 3 automatically or alternatively by way of suitable setting of an operating person starts a training mode. The control stores the values determined by the first measuring device 25*a* as data sets for each spring to be manufactured, assuming that the properties of the manufactured springs 15 lie within the predefined tolerance limits.

Each of these for example two hundred data sets is provided with a remark which permit an unambiguous allocation to the activation function $K_1$ for the corresponding spring type. This activation function $K_1$ is likewise deposited in the memory of the control 3 as a look-up table with e.g. one hundred support locations uniformly distributed over the wire length required for the manufacture of the spring 15. The values stored at the support locations correspond to the activation values for the bender 11*a* at the location of these support locations. The control 3 may compute a first reference data set with the average values or with the median from the previously stored reading data sets and store these. Alternatively the control 3 may also directly store the readings which have preferably been filtered and free from stochastic disturbances. The first reference data set accordingly reflects a constellation of values of the first measuring device 25*a* with which there is not required a correction of the activation function $K_1$.

In an analogous manner the control 3 may form further reference data sets automatically or on manual instruction, e.g. if one of the following criteria is fulfilled:

- the initial activation function $K_1$ was changed to a new or corrected activation function $K_2$ so that the springs 15 to be manufactured have the desired nominal properties
- one or more measured variables of the first measuring device 25*a* deviate significantly from the values contained in the previously stored reference data sets
- the control 3 on account of change of the measured variables of the second measuring device 25*b* ascertains that the spring properties deviate significantly from the nominal values which likewise are stored in a memory medium of the control.

The second and each further reference data set reflects a constellation of values of the first measuring device 25*a* with which a correction of the activation function $K_1$ or another activation function $K_2$, $K_3$ etc. is required in order to be able to produce springs 15 with the desired properties. After the formation of a first or further reference data sets, which e.g. may comprise e.g. the real and imaginary parts of the impedance of the wire 13 at one or more frequencies, the control 3 changes over from training mode into an operating mode in which no further evaluation of reference data sets is effected. The control 3 now starts a comparison algorithm which puts the wire properties detected by the measuring sensors 27 and stored as reference data sets into a relationship with the corrections carried out on the initial activation function $K_1$ e.g. by way of multiple regression or neuronal linking, and seeks correlations between these variables. At the same time additionally to the measured variables of the measuring sensors 27 or to the data of the reference data sets also linear and non-linear functions of measured variables or the data stored in the reference data sets are taken into account. Correlations are then present of the activation function required for the manufacture of the springs or their difference to the original activation function $K_1$ may be deduced from the original activation function $K_1$ and the measured variables of the measurement sensors 27 or the data of the reference data sets. On determining the correlation functions the control 3 may limit the number of measured variables or the corresponding data in the stored data sets such that one only takes into account those parameters which have a significant contribution to the correlation function.

If such correlations are present the control 2 changes the activation of the shaper 11 in a manner such that additionally to the stored original activation function $K_1$ one also may taken into account the readings of the measuring sensors 27 and the allocated correction values or the correlation function for activating the shaper 11.

LIST OF REFERENCE NUMERALS

1 spring winding machine
3 control
5 wire conveying means
5*a,b* wire pull-in rollers
7 wire shaping installation
9 supply part
9*a,b* support rollers
11 shaper
11*a* bender
13 wire
15 spring
17 user interface
19 monitor display
21 keyboard

23 apparatus interface
25 measuring devices
25*a* first measuring device
25*b* second measuring device
27 measuring sensor
29 evaluation unit
31 reference sensor
33 testing sensor

The invention claimed is:

1. A spring winding machine (1) for manufacturing springs (15), comprising a wire conveying device (5) and a wire shaping installation (7), including at least one diameter control tool (11*a*) and at least one pitch control tool (11*b*), which wire shaping installation is controllable by a machine control (3), for selectively controlling movement of at least one of said wire shaping installation tools (11*a*, 11*b*), characterized in that at least one measuring sensor (27) of a measurement device (25) is arranged upstream of the wire shaping installation with respect to the conveying direction of the wire to be shaped, and that at least one of the said pitch and diameter control tools (11*a*, 11*b*) of the wire shaping installation (7) is responsive in its movement to impedances or measured variables influenced by induction or eddy currents detected by the upstream measuring sensor (27).

2. A spring winding machine (1) according to claim 1, characterized in that the measuring sensor (27) is designed for contact-less measurement of one or more measured variables.

3. A spring winding machine (1) according to one of the claims 2 characterized in that the measuring sensor (27) comprises a measurement coil (27).

4. A spring winding machine (1) according to claim 1 which further includes a second measuring device (25*b*) downstream of the wire shaping installation (7) for supplying control signals to the machine control (3).

5. A spring winding machine (1) according to claim 1, characterized in that the machine control (3) further comprises detection means (33) located downstream of the wire shaping installation (7) for detecting and inputting deviations of the spring properties from predefined or presettable nominal values and for inputting correction values.

6. A method of operation of the spring winding machine (1) according to claim 1, characterized in that the control of one or more tools (11, 11*a*, 11*b*) of the wire shaping installation (7) is effected in dependence of one or more predefined or presettable activation functions ($K_1$) and in dependence on measured variables of the measurement device (25).

7. A method according to claim 6, characterized in that the control (3) stores measured variables of the measurement device (25) and processes these further.

8. A method according to claim 7, characterized in that the control (3) determines correlations between the reference data sets and the activation function of the tools (11, 11*a*, 11*b*) of the wire shaping installation.

* * * * *